US007347422B1

(12) United States Patent
Wadowski et al.

(10) Patent No.: US 7,347,422 B1
(45) Date of Patent: Mar. 25, 2008

(54) GAME SYSTEM

(76) Inventors: Peter Z. Wadowski, 4433 E. Meadow Dr., Phoenix, AZ (US) 85032; Katrina Wadowski, 4433 E. Meadow Dr., Phoenix, AZ (US) 85032

( * ) Notice: Subject to any disclaimer, the term of this patent is extended or adjusted under 35 U.S.C. 154(b) by 47 days.

(21) Appl. No.: 11/105,777

(22) Filed: Apr. 13, 2005

Related U.S. Application Data

(60) Provisional application No. 60/562,087, filed on Apr. 13, 2004.

(51) Int. Cl.
*A63F 3/00* (2006.01)

(52) U.S. Cl. ..... 273/288; 273/236

(58) Field of Classification Search ..... 273/288, 273/260, 261, 236; D21/385, 386, 388, 389
See application file for complete search history.

(56) References Cited

U.S. PATENT DOCUMENTS 1,628,412 A * 5/1927 Lesavoy ..... 273/288
3,608,904 A * 9/1971 Margetson ..... 273/288
3,627,324 A 12/1971 Krepp
3,695,615 A 10/1972 Shoptaugh
4,190,256 A * 2/1980 Rudden, Jr. ..... 273/275
4,200,293 A * 4/1980 Benson, III ..... 273/260
4,226,419 A 10/1980 Wooden
4,305,585 A 12/1981 Flynn
4,411,433 A 10/1983 Flynn
4,607,847 A * 8/1986 Chung ..... 273/264
D320,625 S 10/1991 Rubins
5,160,145 A 11/1992 Bokhagen
6,182,967 B1 * 2/2001 Green ..... 273/290
6,412,776 B1 7/2002 Baxter et al.
2003/0141662 A1 * 7/2003 Kost et al. ..... 273/288

* cited by examiner

*Primary Examiner*—Vishu Mendiratta
(74) *Attorney, Agent, or Firm*—Stoneman Volk Patent Group; Michael D. Volk, Jr.; Martin L. Stoneman

(57) ABSTRACT

A game system with game pieces that have combinations of capture indicia and defense indicia spaced at angular increments.

9 Claims, 5 Drawing Sheets

GAME SYSTEM

CROSS-REFERENCE TO RELATED APPLICATION

The present application is a related to and claims priority from prior provisional application Ser. No. 60/562,087, filed Apr. 13, 2004, entitled "GAME SYSTEM", the contents of which are incorporated herein by this reference and are not admitted to be prior art with respect to the present invention by the mention in this cross-reference section.

BACKGROUND

This invention relates to providing a game system. More particularly this invention relates to providing a game system with game pieces that have capture and defense indicia arranged in a variety of configurations angularly spaced in substantially forty-five degree increments. Games, and particularly strategy games, must often balance simplicity with strategic difficulty. Often, in order to provide a game of sufficient strategic difficulty to challenge players and maintain their interest the game must provide a high degree of complexity. Many strategically interesting games are too complicated and involved for beginners to learn quickly and easily. Other games are too simple to provide a challenge after repeated play time and again.

OBJECTS AND FEATURES OF THE INVENTION

A primary object and feature of the present invention is to provide a game system that provides many levels of strategic challenge and interesting game play.

It is a further object and feature of the present invention to provide such a game system that is easy for beginners to learn.

It is a further object and feature of the present invention to provide such a game system with game pieces that can be used to play games with many rule variations. It is a further object and feature of the present invention to provide such a game system that can be played on typical chess and checker boards.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a game piece comprising, in combination: at least eight potential direction indicators; wherein such at least eight potential direction indicators comprise; at least one position-1 potential indicator directed at substantially zero degrees; at least one position-2 potential indicator directed at substantially forty-five degrees; at least one position-3 potential indicator directed at substantially ninety degrees; at least one position-4 potential indicator directed at substantially one-hundred-thirty-five degrees; at least one position-5 potential indicator directed at substantially one hundred-eighty degrees; at least one position-6 potential indicator directed at substantially two-hundred-twenty-five degrees; at least one position-7 potential indicator directed at substantially two-hundred-seventy degrees; and at least one position-8 potential indicator directed at substantially three-hundred fifteen degrees; wherein at least one of such at least eight potential direction indicators comprises capture indicia; wherein at least one of such at least eight potential direction indicators comprises defense indicia. Moreover, it provides such a game piece wherein none of such at least eight potential direction indicators comprises both capture indicia and defense indicia. Additionally, it provides such a game piece wherein at least one such capture indicia and at least one such defense indicia are angularly spaced substantially forty-five degrees apart. Also, it provides such a game piece wherein such at least one position-1 potential indicator comprises defense indicia, such at least one position-2 potential indicator comprises capture indicia, such at least one position-3 potential indicator comprises capture indicia, such at least one position-5 potential indicator comprises capture indicia, such at least one position-7 potential indicator comprises capture indicia, and such at least one position-8 potential indicator comprises capture indicia. In addition, it provides such a game piece wherein such at least one position-1 potential indicator comprises capture indicia, such at least one position-2 potential indicator comprises defense indicia, such at least one position-3 potential indicator comprises capture indicia, such at least one position-7 potential indicator comprises capture indicia, and such at least one position-8 potential indicator comprises defense indicia. And, it provides such a game piece wherein such at least one position-I potential indicator comprises capture indicia, such at least one position-3 potential indicator comprises capture indicia, such at least one position-5 potential indicator comprises defense indicia, and such at least one position-7 potential indicator comprises capture indicia. Further, it provides such a game piece wherein such at least one position-2 potential indicator comprises capture indicia, such at least one position-3 potential indicator comprises defense indicia, such at least one position-4 potential indicator comprises defense indicia, such at least one position-6 potential indicator comprises defense indicia, such at least one position-7 potential indicator comprises defense indicia, and such at least one position-8 potential indicator comprises capture indicia. Even further, it provides such a game piece wherein such at least one position-1 potential indicator comprises defense indicia, such at least one position-2 potential indicator comprises capture indicia, such at least one position-4 potential indicator comprises capture indicia, such at least one position-6 potential indicator comprises capture indicia, and such at least one position-8 potential indicator comprises capture indicia. Moreover, it provides such a game piece wherein such at least one position-1 potential indicator comprises capture indicia, such at least one position-3 potential indicator comprises defense indicia, such at least one position-5 potential indicator comprises defense indicia, and such at least one position-7 potential indicator comprises defense indicia. Additionally, it provides such a game piece wherein such at least one position-1 potential indicator comprises capture indicia, such at least one position-2 potential indicator comprises defense indicia, such at least one position-3 potential indicator comprises defense indicia, such at least one position-5 potential indicator comprises defense indicia, such at least one position-7 potential indicator comprises defense indicia, and such at least one position-8 potential indicator comprises defense indicia. Also, it provides such a game piece wherein such at least one position-1 potential indicator comprises capture indicia, such at least one position-2 potential indicator comprises defense indicia, such at least one position-4 potential indicator comprises defense indicia, such at least one position-6 potential indicator comprises defense indicia, and such at least one position-8 potential indicator comprises defense indicia. In addition, it provides such a game piece wherein such at least one position-2 potential indicator comprises capture indicia, such at least one position-3 potential indicator comprises defense indicia, such at least one position-7 potential indicator comprises defense indicia, and such at least one position-8 potential indicator comprises capture indicia. And, it provides such a game piece wherein such at least one position-1 potential indicator comprises capture indicia, such at least one position-2 potential indicator comprises capture indicia, such at least one position-3 potential indicator comprises defense indicia, such at least one position-5 potential indicator comprises defense indicia, such at least one position-7 potential indicator comprises defense indicia, and such at least one position-8 potential indicator comprises capture indicia. Further, it provides such a game piece wherein such at least one position-1 potential indicator comprises defense indicia, such at least one position-2 potential indicator comprises defense indicia, such at least one position-3 potential indicator comprises capture indicia, such at least one position-7 potential indicator comprises capture indicia, and such at least one position-8 potential indicator comprises defense indicia. Even further, it provides such a game piece wherein such at least one position-2 potential indicator comprises capture indicia, such at least one position-3 potential indicator comprises capture indicia, such at least one position-4 potential indicator comprises defense indicia, such at least one position-6 potential indicator comprises defense indicia, such at least one position-7 potential indicator comprises capture indicia, and such at least one position-8 potential indicator comprises capture indicia.

In accordance with another preferred embodiment hereof, this invention provides a game piece comprising, in combination: at least eight potential direction indicators; wherein such at least eight potential direction indicators comprise; at least one position-1 potential indicator directed at substantially zero degrees; at least one position-2 potential indicator directed at substantially forty-five degrees; at least one position-3 potential indicator directed at substantially ninety degrees; at least one position-4 potential indicator directed at substantially one-hundred-thirty-five degrees; at least one position-5 potential indicator directed at substantially one hundred-eighty degrees; at least one position-6 potential indicator directed at substantially two-hundred-twenty-five degrees; at least one position-7 potential indicator directed at substantially two-hundred-seventy degrees; and at least one position-8 potential indicator directed at substantially three-hundred fifteen degrees; wherein at least one of such at least eight potential direction indicators comprises capture indicia. Moreover, it provides such a game piece wherein each of such at least eight potential direction indicators comprises capture indicia. Additionally, it provides such a game piece wherein such at least one position-1 potential indicator comprises capture indicia, such at least one position-2 potential indicator comprises capture indicia, such at least one position-3 potential indicator comprises capture indicia, such at least one position-5 potential indicator comprises capture indicia, such at least one position-7 potential indicator comprises capture indicia, and such at least one position-8 potential indicator comprises capture indicia. Also, it provides such a game piece wherein such at least one position-1 potential indicator comprises capture indicia, such at least one position-2 potential indicator comprises capture indicia, such at least one position-4 potential indicator comprises capture indicia, such at least one position-6 potential indicator comprises capture indicia, and such at least one position-8 potential indicator comprises capture indicia. In addition, it provides such a game piece wherein such at least one position-2 potential indicator comprises capture indicia, such at least one position-3 potential indicator comprises capture indicia, such at least one position-7 potential indicator comprises capture indicia, and such at least one position-8 potential indicator comprises capture indicia.

In accordance with another preferred embodiment hereof, this invention provides a game piece comprising, in combination: at least one potential direction indicator comprising capture indicia; and at least one potential direction indicator comprising defense indicia; wherein such capture indicia and such defense indicia are angularly spaced substantially forty-five degrees apart. And, it provides such a game piece wherein such game piece comprises at least five potential direction indicators. Further, it provides such a game piece wherein such game piece comprises eight potential direction indicators substantially evenly angularly spaced at substantially forty-five degree increments.

In accordance with another preferred embodiment hereof, this invention provides a method of playing a game comprising the steps of: providing at least one game board comprising at least one grid of spaces; providing a plurality of game pieces which can be positioned on such at least one game board; wherein at least one of such plurality of game pieces comprises at least one capture indicia, and at least one defense indicia, wherein such at least one capture indicia and such at least one defense indicia are angularly spaced substantially forty-five degrees apart. Even further, it provides such a method of playing a game further comprising moving at least one of such plurality of game pieces from one space of such at least one grid of spaces to an adjacent space of such at least one grid of spaces, and rotating such at least one of such plurality of game pieces to a different angular orientation.

DETAILED DESCRIPTION OF THE BEST MODES AND PREFERRED EMBODIMENTS OF THE INVENTION

Figure 1:
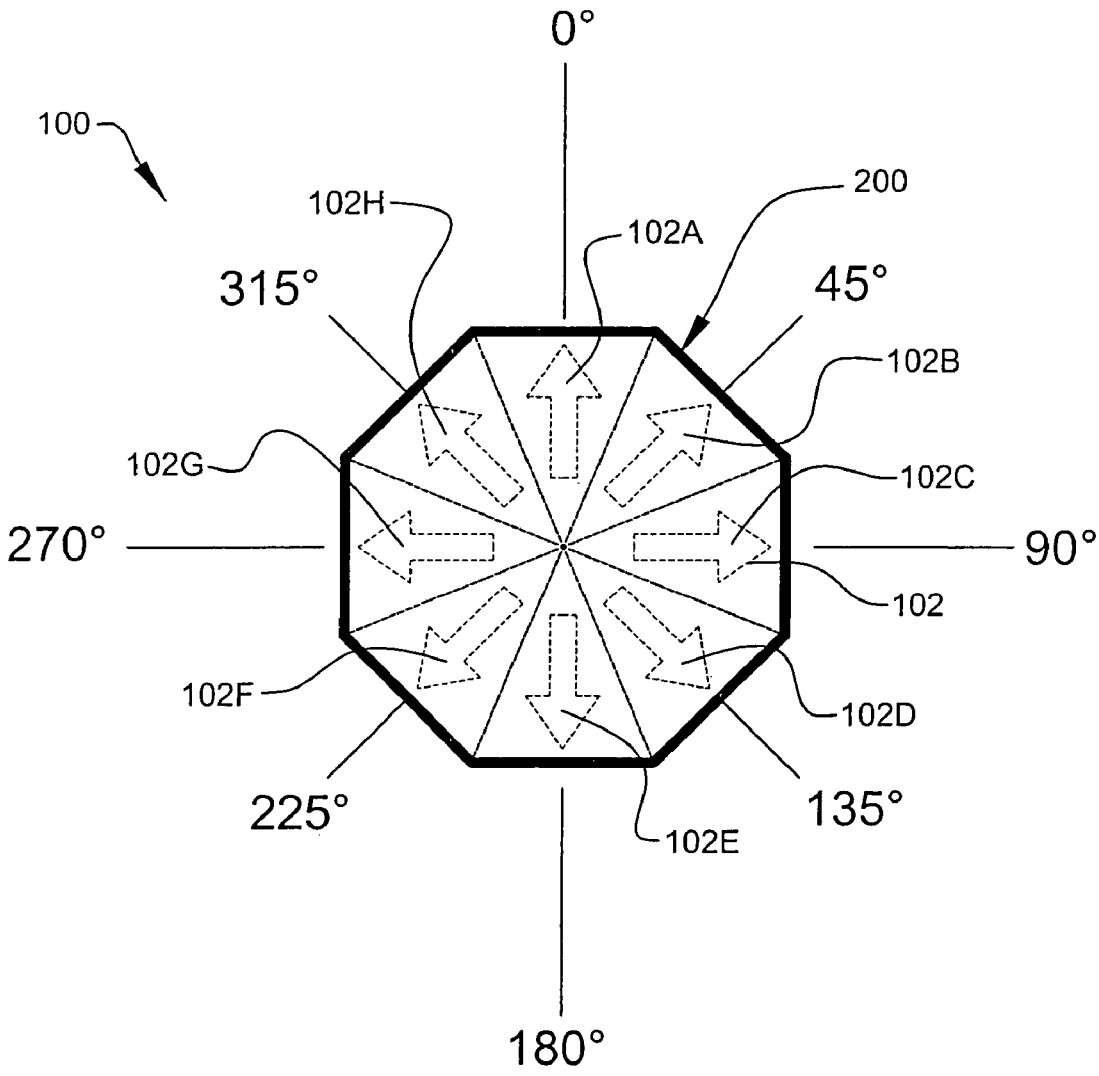
FIG. 1 shows a top view of a game piece of a game system according to a preferred embodiment of the present invention.

FIG. 1 shows a top view of game piece 200 of game system 100 according to a preferred embodiment of the present invention. Preferably, game piece 200 comprises potential direction indicators 102, preferably indicated by the outwardly facing sides of each side (embodying herein at least one potential direction indicator) of an octagonshaped game piece, as shown. Preferably, potential direction indicators 102 are spaced in evenly spaced angular increments, as shown. Preferably, game piece 200 comprises eight potential direction indicators 102, as shown. Preferably, potential direction indicators 102 are angularly spaced at forty-five degree increments (at least embodying herein wherein said game piece comprises eight potential direction indicators substantially evenly angularly spaced at substantially forty-five degree increments). Preferably, potential direction indicator 102A is angularly spaced at substantially zero degrees for the purpose of establishing the relative angles of other potential direction indicators 102 (at least embodying herein at least one position-1 potential indicator directed at substantially zero degrees). Preferably, potential direction indicator 102B is angularly spaced at substantially forty-five degrees (at least embodying herein at least one position-2 potential indicator directed at substantially forty-five degrees). Preferably, potential direction indicator 102C is angularly spaced at substantially ninety degrees. Preferably, potential direction indicator 102D is angularly spaced at substantially one-hundred-thirty-five degrees. Preferably, potential direction indicator 102E is angularly spaced at substantially one-hundred-eighty degrees. Preferably, potential direction indicator 102F is angularly spaced at substantially two-hundred-twenty-five degrees. Preferably, potential direction indicator 102G is angularly spaced at substantially two-hundred-seventy degrees. Preferably, potential direction indicator 102H is angularly spaced at substantially three-hundred-fifteen degrees. Preferably, game piece 200 comprises radial symmetry, as shown, so that game piece 200 may be rotated. Preferably game piece 200 may be rotated so that any one selected potential direction indicator 102 may be oriented at zero degrees. The use of absolute angle measurements (e.g. two-hundred-seventy degrees) in defining the positions of direction indicators 102 is used to help define the relative positions of direction indicators 102 to each other and not to establish an absolute and specific orientation of any particular direction indicators 102, especially since preferably game piece 200 is rotatable. Preferably, each potential direction indicator 102 comprises at least one of the following states: capture 104X, defense 104Y, blank 104Z. Most preferably, each potential direction indicator 102 consists of exactly one of the following states: capture indicia 104X, defense indicia 104Y, or blank 104Z. Preferably, capture indicia 104X comprises arrow indicia, as shown. Preferably, defense indicia 104Y comprises trapezoid indicia, as shown. Preferably, blank 104Z consists of lack of indicia for the respective potential direction indicator 102.

Figure 2:
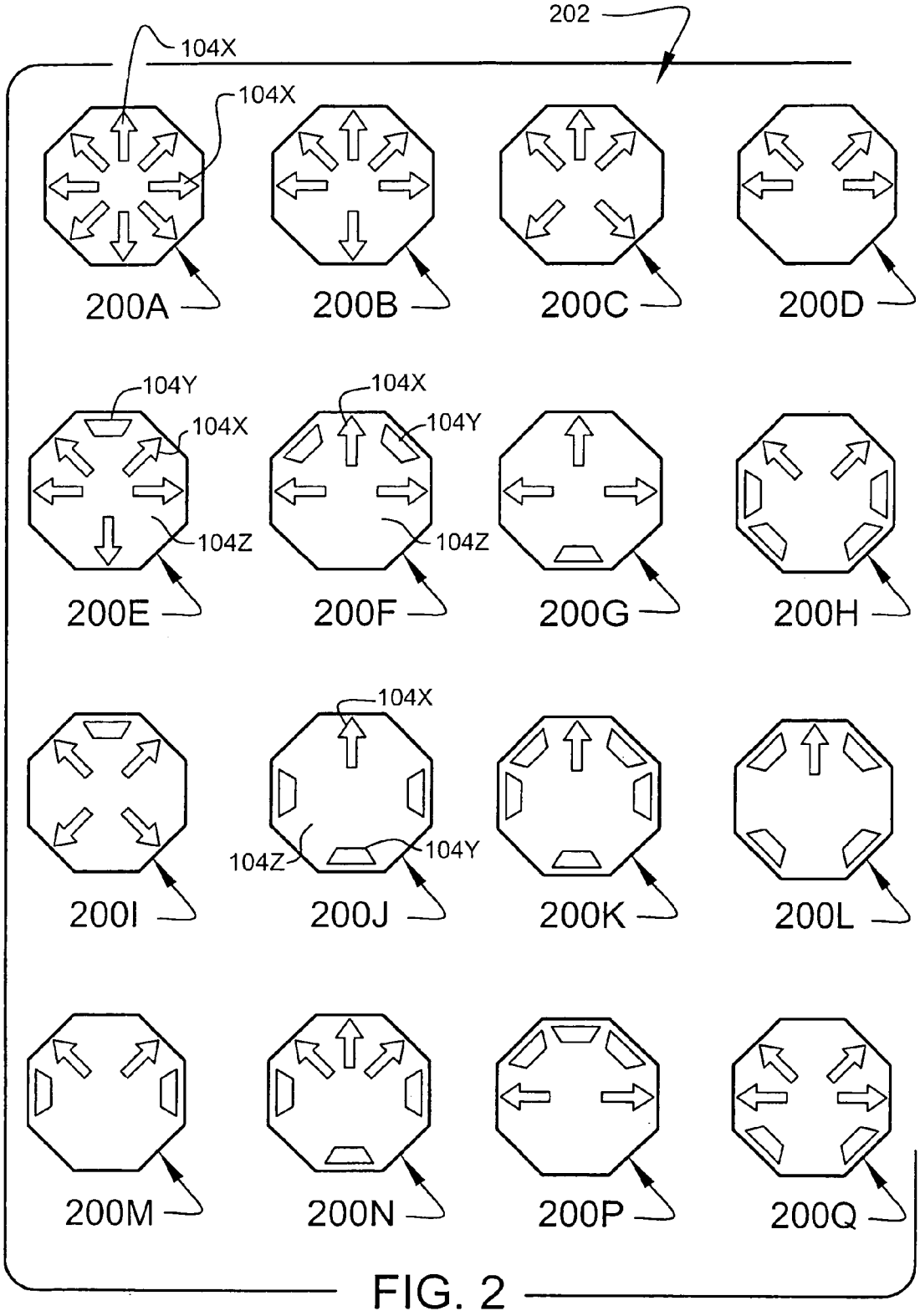
FIG. 2 shows a top view of a set of game pieces according to a preferred embodiment of the present invention.

Upon reading the teachings of this specification, those with ordinary skill in the art will now understand that, under appropriate circumstances, considering issues such as game board geometry, game piece geometry, desired level of strategic complexity, etc., other potential direction indicator arrangements, such as, for example, potential direction indicators spaced in uneven angular increments, potential direction indicators angularly spaced at degree increments other than forty-five degrees (such as, for example, one-hundred-twenty degrees, ninety degrees, seventy-two degrees, sixty degrees, etc.), a greater or fewer number of potential direction indicators (such as, for example, two potential direction indicators, or three, or four, or five, or six, etc.), different states for potential direction indicators (such as, for example, a magnitude associated with movement for a certain direction, eliminating defense indicia or blank, etc.), potential direction indicators that comprise more than one state (such as, for example, combined movement and defense in the same direction), capture indicia comprising indicia other than an arrow (such as, for example, a triangle, square, other shape, a word, or other symbol, etc.), defense indicia comprising indicia other than a trapezoid (such as, for example, a rectangle, asterisk, other shape, a word, or other symbol, etc.), indicia other than "blank" (such as, for example, a circle, dot, other shape, a word, or other symbol, etc.) that indicates "lack of defense and lack of capture" for a given associated potential direction indicator, etc., may suffice FIG. 2 shows a top view of a set of game pieces 202 according to a preferred embodiment of the present invention. Preferably, game system 100 comprises two sets of pieces 202. Preferably, each set of game pieces 202 are easily distinguishable the other set, most preferably by color (such as, for example, a black set of pieces, a white set of pieces, a red set of pieces, an oak set of pieces, a rosewood set of pieces, etc.). Preferably, each set of game pieces comprises game piece 200A, game piece 200B, game piece 200C, game piece 200D, game piece 200E, game piece 200F, game piece 200G, game piece 200H, game piece 200I, game piece 200J, game piece 200K, game piece 200L, game piece 200M, game piece 200N, game piece 200P, and game piece 200Q, as shown. Preferably, game piece 200A comprises capture indicia 104x for each of potential direction indicators 102A, 102B, 102C, 102D, 102E, 102F, 102G, and 102H (at least embodying herein wherein each of said at least eight potential direction indicators comprises capture indicia), as shown. Preferably, game piece 200B comprises capture indicia 104X for each of potential direction indicators 102A, 102B, 102C, 102E, 102G, and 102H, and blank 104Z for potential direction indicators 102D and 102F (at least embodying herein wherein game piece comprises at least five potential direction indicators), as shown. Preferably, game piece 200C comprises capture indicia 104X for each of potential direction indicators 102A, 102B, 102D, 102F, and 102H, and blank 104Z for potential direction indicators 102C, 102E, and 102G, as shown. Preferably, game piece 200D comprises capture indicia 104X for each of potential direction indicators 102B, 102C, 102G, and 102H, and blank 104Z for potential direction indicators 102A, 102D, 102E, and 102F, as shown. Preferably, game piece 200E comprises capture indicia 104X for each of potential direction indicators 102B, 102C, 102E, 102G, and 102H (at least embodying herein wherein at least one of said at least eight potential direction indicators comprises capture indicia), defense indicia 104Y for potential direction indicator 102A (at least embodying herein wherein at least one of said at least eight potential direction indicators comprises defense indicia; and at least embodying herein wherein at least one said capture indicia and at least one said defense indicia are angularly spaced substantially forty-five degrees apart; and at least embodying herein wherein at least one position-1 potential indicator comprises capture indicia, at least one position-3 potential indicator comprises capture indicia, at least one position-5 potential indicator comprises defense indicia, and at least one position-7 potential indicator comprises capture indicia), and blank 104Z for potential direction indicators 102D, and 102F, as shown. Preferably, game piece 200F comprises capture indicia 104X for each of potential direction indicators 102A, 102C, and 102G, defense indicia 104Y for potential direction indicators 102B and 102H, and blank 104Z for potential direction indicators 102D, 102E and 102F, as shown. Preferably, game piece 200G comprises capture indicia 104X for each of potential direction indicators 102A, 102C, and 102G, defense indicia 104Y for potential direction indicator 102E, and blank 104Z for potential direction indicators 102B, 102D, 102F, and 102H, as shown. Preferably, game piece 200H comprises capture indicia 104X for each of potential direction indicators 102B and 102H, defense indicia 104Y for potential direction indicators 102C, 102D, 102F, and 102G, and blank 104Z for potential direction indicators 102A and 102E, as shown. Preferably, game piece 200I comprises capture indicia 104X for each of potential direction indicators 102B, 102D, 102F, and 102H, defense indicia 104Y for potential direction indicator 102A, and blank 104Z for potential direction indicators 102C, 102E, and 102G, as shown. Preferably, game piece 200J comprises capture indicia 104X for each of potential direction indicators 102A, defense indicia 104Y for potential direction indicators 102C, 102E, and 102G, and blank 104Z for potential direction indicators 102B, 102D, 102F, and 102H, as shown. Preferably, game piece 200K comprises capture indicia 104X for each of potential direction indicators 102A, defense indicia 104Y for potential direction indicators 102B, 102C, 102E, 102G and 102H, and blank 104Z for potential direction indicators 102D and 102F, as shown. Preferably, game piece 200L comprises capture indicia 104X for each of potential direction indicators 102A, defense indicia 104Y for potential direction indicators 102B, 102D, 102F and 102H, and blank 104Z for potential direction indicators 102C, 102E, and 102G, as shown. Preferably, game piece 200M comprises capture indicia 104X for each of potential direction indicators 102B and 102H, defense indicia 104Y for potential direction indicators 102C and 102G, and blank 104Z for potential direction indicators 102A, 102D, 102E, and 102F, as shown. Preferably, game piece 200N comprises capture indicia 104X for each of potential direction indicators 102A, 102B, and 102H, defense indicia 104Y for potential direction indicators 102C, 102E, and 102G, and blank 104Z for potential direction indicators 102D and 102F, as shown. Preferably, game piece 200P comprises capture indicia 104X for each of potential direction indicators 102C and 102G, defense indicia 104Y for potential direction indicators 102A, 102B, and 102H, and blank 104Z for potential direction indicators 102D, 102E, and 102F, as shown. Preferably, game piece 200Q comprises capture indicia 104X for each of potential direction indicators 102B, 102C, 102G, and 102H, defense indicia 104Y for potential direction indicators 102D and 102F, and blank 104Z for potential direction indicators 102A and 102E, as shown. Preferably, game piece 200 comprises an octagonal shape as shown. Upon reading the teachings of this specification, those with ordinary skill in the art will now understand that, under appropriate circumstances, considering issues such as game board geometry, number of potential direction indicators, desired level of strategic complexity, etc., other game piece arrangements, such as, for example, different arrangements and/or combinations of potential direction indicators and potential direction indicator states, differently shaped game pieces (such as, for example, with more or few sides, round shaped, triangular shaped, square shaped, pentagon shaped, non-geometrically shaped, fancifully or iconic shaped, three-dimensional shaped, sets of game pieces which are distinguishable from other sets by means in addition (or instead of) color (such as, for example, one set has a matte finish, and another set a glossy finish, etc.), etc., may suffice.

Figure 3:
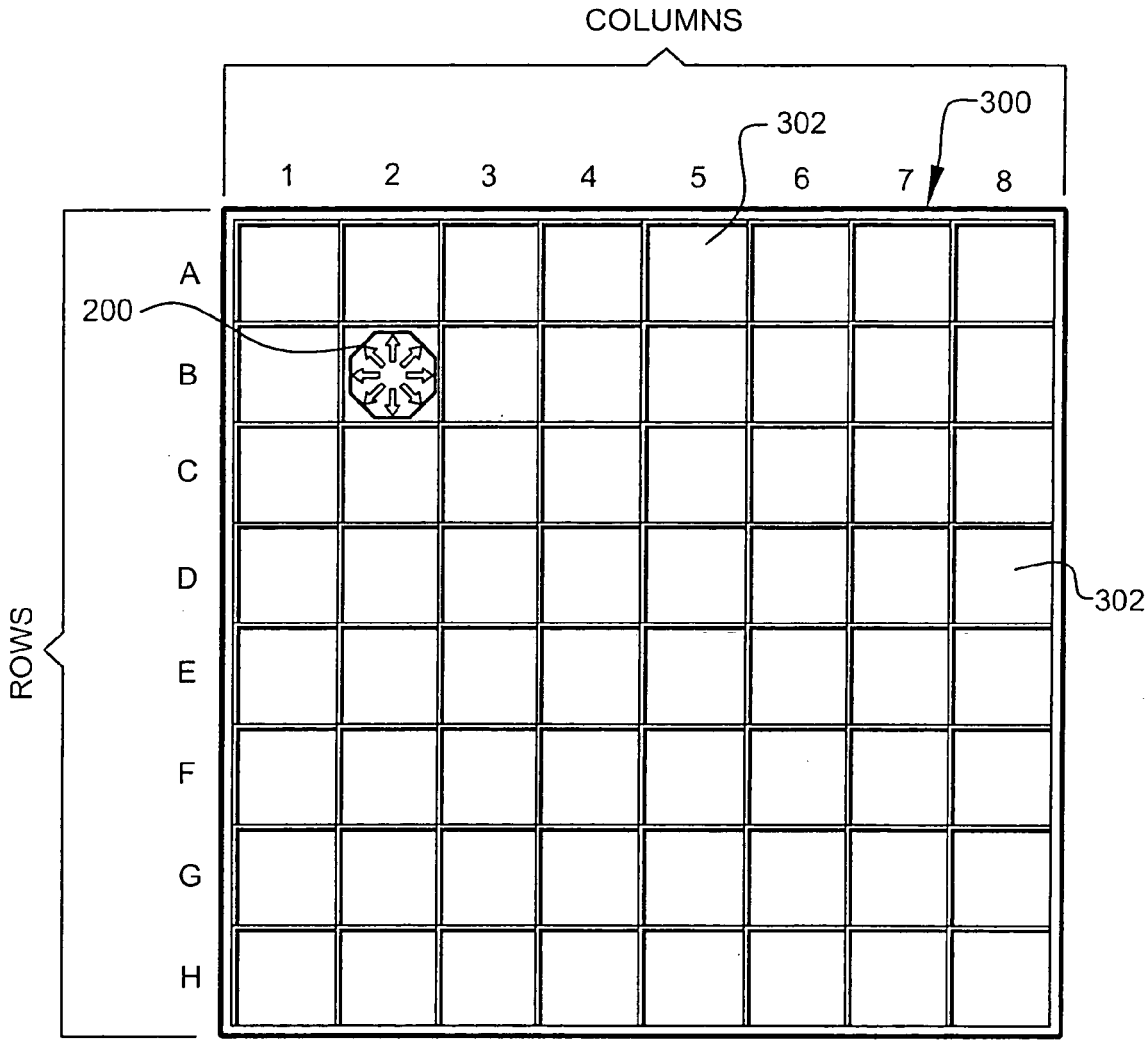
FIG. 3 shows a top view of the game piece of FIG. 1 on a game board according to a preferred embodiment of the present invention.

FIG. 3 shows a top view of game piece 200A on game board 300 according to a preferred embodiment of the present invention. Preferably, game system 100 comprises game board 300, and a plurality of game pieces 200 for positioning on game board 300 (at least embodying herein providing at least one game board comprising at least one grid of spaces and providing a plurality of game pieces which can be positioned on said at least one game board). Preferably, game board 300 comprises a grid of spaces 302, as shown. Preferably, game board 300 has eight columns of square spaces 302 and eight rows of square spaces 302, as shown. Preferably, game pieces 200 are sized to fit within spaces 302, as shown. Preferably, game pieces 200 are sized to fit within the spaces of a standard United States Chess Federation regulation size chess board. Preferably, when a game piece 200 is placed on a space 302 of game board 300, game piece 200 is oriented so that potential direction indicators 102 correlate with (point to) the spaces 302 adjacent to the space occupied by game piece 200, as shown. Upon reading the teachings of this specification, those with ordinary skill in the art will now understand that, under appropriate circumstances, considering issues such as game piece geometry, number of potential direction indicators, desired level of strategic complexity, etc., other game board arrangements, such as, for example, more or fewer columns and/or rows (such as, for example, ten columns and twelve rows, etc.), spaces shaped other than as squares (such as, for example, triangles, hexagons, octagons, etc.), a board shaped other than a grid (such as, for example, a maze with corridors, rooms, and/or obstacles, etc.), a smaller or larger game board with smaller or larger spaces, etc., may suffice.

Preferred rules of play: Preferably, the game is played by two players. Upon reading the teachings of this specification, those with ordinary skill in the art will now understand that, under appropriate circumstances, considering issues such as game piece geometry, desired level of strategic complexity, etc., other player arrangements such as, for example, additional players with additional sets of pieces, a single player, teams of players that share control of pieces depending on different game factors, teams of players that do not share control of pieces, etc., may suffice Types of pieces: Preferably, each set of games pieces 202 comprises sixteen games pieces: game piece 200A, game piece 200B, game piece 200C, game piece 200D, game piece 200E, game piece 200F, game piece 200G, game piece 200H, game piece 200I, game piece 200J, game piece 200K, game piece 200L, game piece 200M, game piece 200N, game piece 200P, and game piece 200Q, as shown. Upon reading the teachings of this specification, those with ordinary skill in the art will now understand that, under appropriate circumstances, considering issues such as game piece geometry, game board geometry, number of potential direction indicators, desired level of strategic complexity, rules of play, etc., other sets of game piece arrangements may suffice, such as, for example, more or fewer game pieces (such as, for example, a subset of the preferred game pieces, additional and/or replacement game pieces with unique/different or duplicate potential direction indicator arrangements, etc.), etc., may suffice.

Preferably, game pieces 200 are classified into three categories: King, Noblemen, and Knights. Preferably, game piece 200A is the King and may move one or two spaces. Preferably, game pieces without defense indicia 104Y (excluding the King) are Noblemen (such as, for example, game pieces 200B, 200C, and 200D). Preferably, Noblemen game pieces 200B, 200C, and 200D may move any number of spaces (preferably in one of the directions available indicated by capture indicia 104X) and may then rotate to any (proper incremental) orientation after movement is complete. Preferably, game pieces with defense indicia 104Y are Knights (e.g. game pieces 200E, 200F, 200G, 200H, 200I, 200J, 200K, 200L, 200M, 200N, 200P, and 200Q). Preferably, when a Knight game piece is moved the player has the option of moving one space and then rotating (at least embodying herein moving at least one of said plurality of game pieces from one space of said at least one grid of spaces to an adjacent space of said at least one grid of spaces, and rotating said at least one of said plurality of game pieces to a different angular orientation), or moving two spaces without rotating. Preferably, when any piece moves more than one space the additional spaces must be in the same direction (as the initial move) in a straight line. Preferably, when a game piece 200 is rotated it may be placed in any rotational orientation as long as potential direction indicators 102 correlate with (point to) spaces 302 adjacent to the spaces occupied by game piece 200 (i.e. rotational increments of forty-five degrees for eight-sided game pieces). Preferably, game pieces must move in one of the directions available indicated by capture indicia 104X before rotating (game piece may not rotate first and then move). Preferably, game pieces 200 may only move in a direction selected from those indicated by capture indicia 104X. Upon reading the teachings of this specification, those with ordinary skill in the art will now understand that, under appropriate circumstances, considering issues such as game piece geometry, game board geometry, desired level of strategic complexity, rules of play, etc., other rules for classifying and moving game pieces, such as, for example, game pieces may move in any direction regardless of directions indicated by capture indicia, a game piece other than 200A may be classified as the King (such as, for example, a game piece where only one potential direction indicator comprises capture indicia, etc.), more or fewer and/or alternate classifications may be used, different game pieces may be allowed more or less movement and/or rotation (such as, for example, the King may be restricted to moving one space per turn or may be allowed to move more than two spaces per turn, Noblemen may be restricted to moving less than a certain maximum number of spaces per turn, rotation of game pieces may be prohibited or restricted to a limited angular increment per turn, etc.), game pieces may be allowed to rotate in place instead of moving, or may be allowed to rotate and then move on a turn, rotation of a game piece (such as, for example, a Knight, etc.) may be independent of movement, using a randomizing factor (such as, for example, the roll of a six-sided-die) to determine how many spaces a game piece may move on a turn, etc., may suffice.

Preferably an attacking game piece can only be moved onto a space occupied by an opponent's piece when the attacking game piece has capture indicia 104X pointing in the direction of movement. Preferably, when a player moves a game piece onto a space occupied by an opponent's game piece, the opponent's game piece is captured (preferably, the captured piece is removed from the game board). However, a game piece 200 with defense indicia 104Y has a barrier protecting against movement into the space from the direction indicated by defense indicia 104Y (immunity against capture from the direction indicated by defense indicia 104Y). Preferably, capture indicia 104X does not provide immunity against capture from the direction indicated by capture indicia 104X (preferably, game pieces 200 are vulnerable from the direction in which they may potentially capture). Preferably, two game pieces 200 may not occupy the same space. Preferably, game pieces 200 may not "jump over" any other game pieces 200. Upon reading the teachings of this specification, those with ordinary skill in the art will now understand that, under appropriate circumstances, considering issues such as game piece geometry, game board geometry, desired level of strategic complexity, rules of play, etc., other game piece attack/defense arrangements, such as, for example, allowing game pieces to occupy the same space, allowing game pieces to jump over other game pieces, etc., may suffice.

Objective of game: Preferably, the object of the game is to checkmate the opponents King (game piece 200A) by trapping it in a position from which escape is impossible and capture is unavoidable. Upon reading the teachings of this specification, those with ordinary skill in the art will now understand that, under appropriate circumstances, considering issues such as game piece geometry, game board geometry, desired level of strategic complexity, rules of play, etc., other game objectives may suffice, such as, for example, occupying a certain space (or multiple spaces) on the game board, capturing a certain number of the opponent's game pieces, blocking the opponent from moving, etc.

Set-up phase: Preferably, the game begins with a set-up phase in which players place game pieces 202 of their color on the empty game board 300. Preferably, players select one of the available sets of game pieces 202 (such as, for example, black or white, etc.). Preferably, players sit on opposite ends of game board 300 (such as, for example, so that row A of game board 300 is closer to the player with the black set of game pieces 202, and row H is closer to the player with the white set of game pieces 202). Preferably, play begins with an empty board and with the white player placing any one game piece 200 (from the white set of game pieces 202) on board 300. Preferably, the white player is restricted to placing white game pieces 200 in the two rows of game board 300 closest to the white player (e.g. row G and Row H). Preferably, the black player is restricted to placing black game pieces 200 in the two rows of game board 300 closest to the black player (e.g. row A and Row B). Preferably, game pieces 200 may be placed in any rotational orientation as long as potential direction indicators 102 correlate with (point to) squares 302 adjacent to the square occupied by game piece 200 (i.e. rotational increments of forty-five degrees for eight-sided game pieces). Preferably, once a game piece is placed and oriented on game board 300 it is not moved nor rotated until the set-up phase of the game is over (which occurs when all players have placed all the game pieces 200 from their sets of game pieces 202). After the white player places white's first game piece 200, the black player places two game pieces 200. The white player and black player then alternate, taking turns placing two game pieces 200 at a time on board 300, with white placing the last game piece 200. Upon reading the teachings of this specification, those with ordinary skill in the art will now understand that, under appropriate circumstances, considering issues such as type of game pieces, game board geometry, desired level of strategic complexity, rules of play, etc., other game setup arrangements, such as, for example, having game pieces placed on the board according to a predefined arrangement, having players place the pieces on the board, restricting placement of pieces to different portions of the game board, not restricting placement of pieces to certain portions of the game board, placing game pieces in a different sequence or order (such as, for example, requiring the King to be placed first or last, placing game pieces one at a time instead of two at a time, etc.), having each player secretly place all their game pieces and then both players reveal their game pieces at the same time after all game pieces have been placed, etc., may suffice.

Movement phase: Preferably, after the set-up phase is complete, the movement phase begins. Beginning with the white player, players alternate, selecting one piece to move.

Players continue moving until one player checkmates the opponent's King (game piece 200A).

Figure 4:
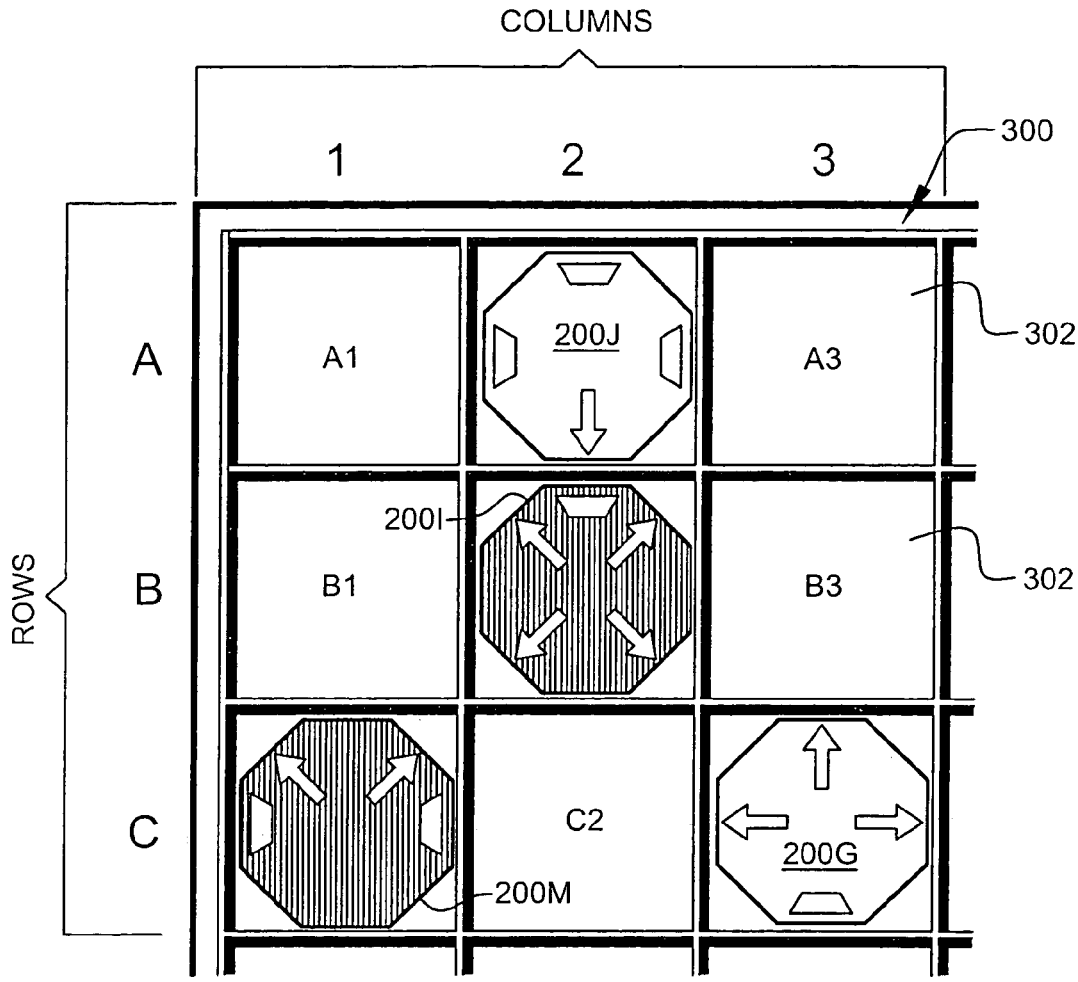
FIG. 4 shows a top view of several game pieces placed on a portion of a game board according to a preferred embodiment of the present invention.

FIG. 4 shows a top view of several game pieces 200 placed on a portion of a game board 300 according to a preferred embodiment of the present invention. White game piece 200J is shown in row A, column 2 of game board 300. Black game piece 2001 is shown in row B, column 2 of game board 300. Black game piece 200M is shown in row C, column 1 of game board 300. White game piece 200G is shown in row C, column 3 of game board 300. In the position shown in FIG. 4, according to the preferred rules of play, game piece 200J (in row A, column 2) is temporarily trapped (cannot move) since it only has one capture indicia 104X which is pointing to a space occupied by game piece 200I (in row B, column 2) which is invulnerable to attack from the direction of game piece 200J (as indicated by defense indicia 104Y on game piece 200I). Black game piece 200I has the option of moving one space to A1 and then rotating, or moving one space to A3 and then rotating, or capturing white game piece 200G in row C, column 3 and then rotating. Black game piece 200I cannot move into row C, column 1 because that space is already occupied by a black game piece, as shown. Black game piece 200M is temporarily trapped because one of it's capture indicia 104X points off the board and the only other capture indicia 104X points to a space (row B, column 2) which is already occupied by a black game piece, as shown. White game piece 200G can move one space to C2 and then rotate, or move one space to B3 and rotate, or move two spaces to A3 and not rotate (keeping the same orientation). White game piece 200G cannot capture black game piece 200M because game piece 200M has defense indicia 104Y protecting against attack from the direction of game piece 200G, as shown.

Figure 5:
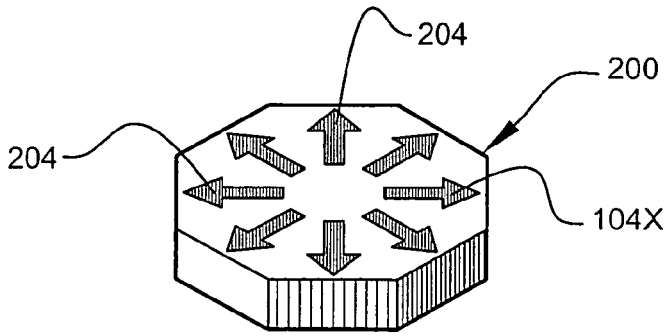
FIG. 5 shows a perspective view of the game piece of FIG. 1.

FIG. 5 shows a perspective view of a game piece 200. Preferably, game piece 200 has eight sides, as shown. Preferably, game piece 200 comprises wood. Preferably, a set of game pieces 202 for one player comprise one type of wood (such as, for example, rosewood) and a set of game pieces 202 for the opposing player is made of a different, easily distinguishable type of wood (such as, for example, oak, teak, etc.). Preferably, capture indicia 104X and defense indicia 104Y are cut into game piece 200 using a laser. Preferably, capture indicia 104X comprises a hole that passes completely through game piece 200. Preferably, defense indicia 104Y comprises a hole that passes completely through game piece 200. Upon reading the teachings of this specification, those with ordinary skill in the art will now understand that, under appropriate circumstances, considering issues such as type of game pieces, game board geometry, desired level of strategic complexity, rules of play, etc., other game setup arrangements, such as, for example, game pieces may comprise other materials (such as, for example, plastic, metal, etc.), game pieces may comprise images which are electronically generated by a computer, capture indicia 104X and defense indicia 104Y may comprise other types of indicia (such as, for example, indicia that is applied to the surface of the game piece, painted on, dyed, extruded, molded, etc.), etc., may suffice.

Figure 6:
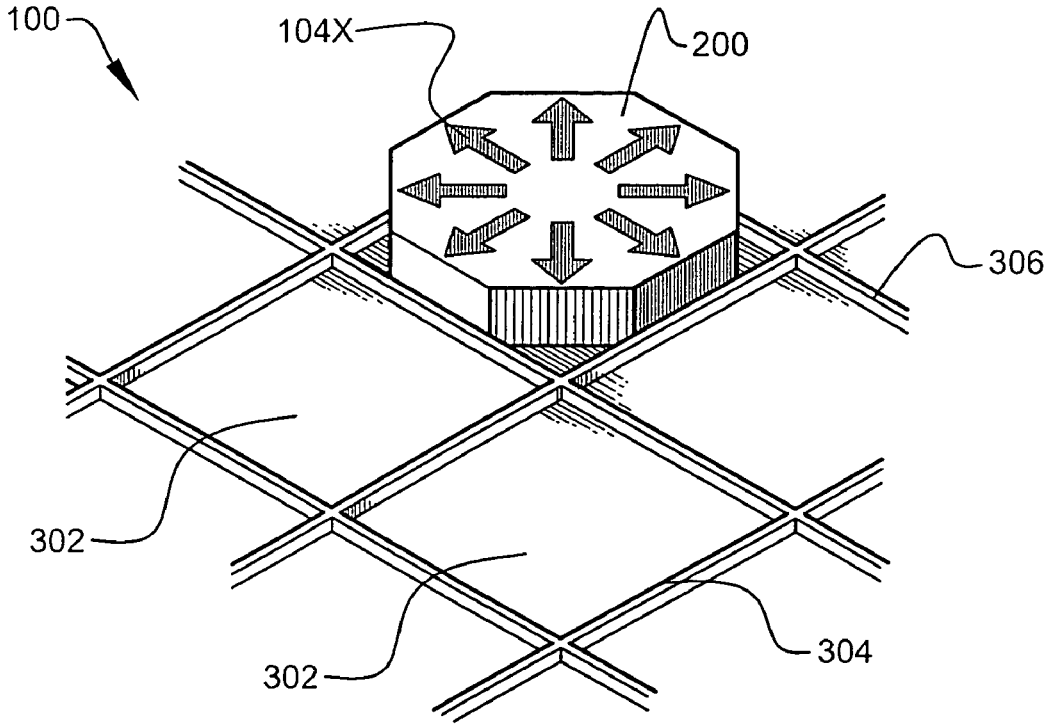
FIG. 6 shows a perspective view of the game piece of FIG. 1 placed on a portion of a game board according to a preferred embodiment of the present invention.

FIG. 6 shows a perspective view of game piece 200 placed on a portion of game board 300. Preferably, game board 300 comprises orientation guides 304 to assist in keeping game pieces 200 oriented properly (such as, for example, to help prevent game pieces from accidentally being disoriented if game board 300 is jostled, etc.). Preferably, orientation guides 304 comprise raised edges 306 around the perimeter of spaces 302 of game board 300, as shown. Preferably, game pieces 200 snugly abut the raised edges 306 to prevent accidental movement and rotation, as shown. Upon reading the teachings of this specification, those with ordinary skill in the art will now understand that, under appropriate circumstances, considering issues such as type of game pieces, game board geometry, production cost, user demand, convenience, etc., other game board arrangements may suffice, such as, for example, omitting orientation guides and raised edges, or providing alternate types of orientation guides (such as, for example, holes/slots/etc. in game board into which portions of game pieces are inserted, or magnetic alignment devices, etc.), etc.

Preferably, game pieces 200 and game board 300 comprise tangible material. In an alternate preferred embodiment of the present invention, game pieces 200 and game board 300 are created by computer program which generates game pieces 200 and game board 300 virtually and displays them so that players can play the game on a computer (such as, for example, against an artificial intelligence program, or against an opponent over the internet, etc.).

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A game piece comprising, in combination:

a) at least eight potential direction indicators;

b) wherein said at least eight potential direction indicators comprise c) at least one position-1 potential indicator directed at substantially zero degrees;

d) at least one position-2 potential indicator directed at substantially forty-five degrees from said at least one position-1 potential indicator;

e) at least one position-3 potential indicator directed at substantially ninety degrees from said at least one position-1 potential indicator;

f) at least one position-4 potential indicator directed at substantially one-hundred-thirty-five degrees from said at least one position-1 potential indicator;

g) at least one position-5 potential indicator directed at substantially one hundred-eighty degrees from said at least one position-1 potential indicator;

h) at least one position-6 potential indicator directed at substantially two-hundred-twenty-five degrees from said at least one position-1 potential indicator;

i) at least one position-7 potential indicator directed at substantially two-hundred-seventy degrees from said at least one position-1 potential indicator; and j) at least one position-8 potential indicator directed at substantially three-hundred fifteen degrees from said at least one position-1 potential indicator;

k) wherein at least one of said at least eight potential direction indicators comprises capture indicia;

l) wherein at least one of said at least eight potential direction indicators comprises defense indicia;

m) wherein each said capture indicia is permanently fixed to said game piece;

n) wherein each said defense indicia is permanently fixed to said game piece;

o) wherein none of said at least eight potential direction indicators comprises both capture indicia and defense indicia;

p) wherein at least one said capture indicia and at least one said defense indicia are angularly spaced substantially forty-five degrees apart;

r) wherein said at least one position-1 potential indicator comprises defense indicia;

s) wherein said at least one position-2 potential indicator comprises capture indicia;

t) wherein said at least one position-3 potential indicator comprises capture indicia;

u) wherein said at least one position-5 potential indicator comprises capture indicia;

v) wherein said at least one position-7 potential indicator comprises capture indicia; and w) wherein said at least one position-8 potential indicator comprises capture indicia.

2. A game piece comprising, in combination:

a) at least eight potential direction indicators;

b) wherein said at least eight potential direction indicators comprise c) at least one position-1 potential indicator directed at substantially zero degrees;

d) at least one position-2 potential indicator directed at substantially forty-five degrees from said at least one position-1 potential indicator;

e) at least one position-3 potential indicator directed at substantially ninety degrees from said at least one position-1 potential indicator;

f) at least one position-4 potential indicator directed at substantially one-hundred-thirty-five degrees from said at least one position-1 potential indicator;

g) at least one position-5 potential indicator directed at substantially one hundred-eighty degrees from said at least one position-1 potential indicator;

h) at least one position-6 potential indicator directed at substantially two-hundred-twenty-five degrees from said at least one position-l potential indicator;

i) at least one position-7 potential indicator directed at substantially two-hundred-seventy degrees from said at least one position-1 potential indicator; and j) at least one position-8 potential indicator directed at substantially three-hundred fifteen degrees from said at least one position-1 potential indicator;

k) wherein at least one of said at least eight potential direction indicators comprises capture indicia;

l) wherein at least one of said at least eight potential direction indicators comprises defense indicia;

m) wherein each said capture indicia is permanently fixed to said game piece;

n) wherein each said defense indicia is permanently fixed to said game piece;

o) wherein none of said at least eight potential direction indicators comprises both capture indicia and defense indicia;

p) wherein at least one said capture indicia and at least one said defense indicia are angularly spaced substantially forty-five degrees apart;

r) wherein said at least one position-2 potential indicator comprises capture indicia;

s) wherein said at least one position-3 potential indicator comprises defense indicia;

t) wherein said at least one position-4 potential indicator comprises defense indicia;

u) wherein said at least one position-6 potential indicator comprises defense indicia;

v) wherein said at least one position-7 potential indicator comprises defense indicia; and w) wherein said at least one position-8 potential indicator comprises capture indicia.

3. A game piece comprising, in combination:

a) at least eight potential direction indicators;

b) wherein said at least eight potential direction indicators comprise c) at least one position-1 potential indicator directed at substantially zero degrees;

d) at least one position-2 potential indicator directed at substantially forty-five degrees from said at least one position-1 potential indicator;

e) at least one position-3 potential indicator directed at substantially ninety degrees from said at least one position-1 potential indicator;

f) at least one position-4 potential indicator directed at substantially one-hundred-thirty-five degrees from said at least one position-1 potential indicator;

g) at least one position-5 potential indicator directed at substantially one hundred-eighty degrees from said at least one position-1 potential indicator;

h) at least one position-6 potential indicator directed at substantially two-hundred-twenty-five degrees from said at least one position-1 potential indicator;

i) at least one position-7 potential indicator directed at substantially two-hundred-seventy degrees from said at least one position-1 potential indicator; and j) at least one position-8 potential indicator directed at substantially three-hundred fifteen degrees from said at least one position-1 potential indicator;

k) wherein at least one of said at least eight potential direction indicators comprises capture indicia;

l) wherein at least one of said at least eight potential direction indicators comprises defense indicia;

m) wherein each said capture indicia is permanently fixed to said game piece;

n) wherein each said defense indicia is permanently fixed to said game piece;

o) wherein none of said at least eight potential direction indicators comprises both capture indicia and defense indicia;

p) wherein at least one said capture indicia and at least one said defense indicia are angularly spaced substantially forty-five degrees apart;

r) wherein said at least one position-1 potential indicator comprises capture indicia;

s) wherein said at least one position-2 potential indicator comprises defense indicia;

t) wherein said at least one position-3 potential indicator comprises defense indicia;

u) wherein said at least one position-5 potential indicator comprises defense indicia;

v) wherein said at least one position-7 potential indicator comprises defense indicia; and w) wherein said at least one position-8 potential indicator comprises defense indicia.

4. A game piece comprising, in combination:

a) at least eight potential direction indicators;

b) wherein said at least eight potential direction indicators comprise c) at least one position-1 potential indicator directed at substantially zero degrees;

d) at least one position-2 potential indicator directed at substantially forty-five degrees from said at least one position-1 potential indicator;

e) at least one position-3 potential indicator directed at substantially ninety degrees from said at least one position-1 potential indicator;

f) at least one position-4 potential indicator directed at substantially one-hundred-thirty-five degrees from said at least one position-1 potential indicator;

g) at least one position-5 potential indicator directed at substantially one hundred-eighty degrees from said at least one position-1 potential indicator;

h) at least one position-6 potential indicator directed at substantially two-hundred-twenty-five degrees from said at least one position-1 potential indicator;

i) at least one position-7 potential indicator directed at substantially two-hundred-seventy degrees from said at least one position-1 potential indicator; and j) at least one position-8 potential indicator directed at substantially three-hundred fifteen degrees from said at least one position-1 potential indicator;

k) wherein at least one of said at least eight potential direction indicators comprises capture indicia;

l) wherein at least one of said at least eight potential direction indicators comprises defense indicia;

m) wherein each said capture indicia is permanently fixed to said game piece;

n) wherein each said defense indicia is permanently fixed to said game piece;

o) wherein none of said at least eight potential direction indicators comprises both capture indicia and defense indicia;

p) wherein at least one said capture indicia and at least one said defense indicia are angularly spaced substantially forty-five degrees apart;

r) wherein said at least one position-1 potential indicator comprises capture indicia;

s) wherein said at least one position-2 potential indicator comprises capture indicia;

t) wherein said at least one position-3 potential indicator comprises defense indicia;

u) wherein said at least one position-5 potential indicator comprises defense indicia;

v) wherein said at least one position-7 potential indicator comprises defense indicia; and w) wherein said at least one position-8 potential indicator comprises capture indicia.

5. A game piece comprising, in combination:

a) at least eight potential direction indicators;

b) wherein said at least eight potential direction indicators comprise c) at least one position-1 potential indicator directed at substantially zero degrees;

d) at least one position-2 potential indicator directed at substantially forty-five degrees from said at least one position-1 potential indicator;

e) at least one position-3 potential indicator directed at substantially ninety degrees from said at least one position-1 potential indicator;

f) at least one position-4 potential indicator directed at substantially one-hundred-thirty-five degrees from said at least one position-1 potential indicator;

g) at least one position-5 potential indicator directed at substantially one hundred-eighty degrees from said at least one position-1 potential indicator;

h) at least one position-6 potential indicator directed at substantially two-hundred-twenty-five degrees from said at least one position-1 potential indicator;

i) at least one position-7 potential indicator directed at substantially two-hundred-seventy degrees from said at least one position-1 potential indicator; and j) at least one position-8 potential indicator directed at substantially three-hundred fifteen degrees from said at least one position-1 potential indicator;

k) wherein at least one of said at least eight potential direction indicators comprises capture indicia;

l) wherein at least one of said at least eight potential direction indicators comprises defense indicia;

m) wherein each said capture indicia is permanently fixed to said game piece;

n) wherein each said defense indicia is permanently fixed to said game piece;

o) wherein none of said at least eight potential direction indicators comprises both capture indicia and defense indicia;

p) wherein at least one said capture indicia and at least one said defense indicia are angularly spaced substantially forty-five degrees apart;

r) wherein said at least one position-1 potential indicator comprises defense indicia;

s) wherein said at least one position-2 potential indicator comprises defense indicia;

t) wherein said at least one position-3 potential indicator comprises capture indicia;

u) wherein said at least one position-7 potential indicator comprises capture indicia; and v) wherein said at least one position-8 potential indicator comprises defense indicia.

6. A game piece comprising, in combination:

a) at least eight potential direction indicators;

b) wherein said at least eight potential direction indicators comprise c) at least one position-1 potential indicator directed at substantially zero degrees;

d) at least one position-2 potential indicator directed at substantially forty-five degrees from said at least one position-1 potential indicator;

e) at least one position-3 potential indicator directed at substantially ninety degrees from said at least one position-1 potential indicator;

f) at least one position-4 potential indicator directed at substantially one-hundred-thirty-five degrees from said at least one position-1 potential indicator;

g) at least one position-5 potential indicator directed at substantially one hundred-eighty degrees from said at least one position-1 potential indicator;

h) at least one position-6 potential indicator directed at substantially two-hundred-twenty-five degrees from said at least one position-1 potential indicator;

i) at least one position-7 potential indicator directed at substantially two-hundred-seventy degrees from said at least one position-1 potential indicator; and j) at least one position-8 potential indicator directed at substantially three-hundred fifteen degrees from said at least one position-1 potential indicator;

k) wherein at least one of said at least eight potential direction indicators comprises capture indicia;

l) wherein at least one of said at least eight potential direction indicators comprises defense indicia;

m) wherein each said capture indicia is permanently fixed to said game piece;

n) wherein each said defense indicia is permanently fixed to said game piece;

o) wherein none of said at least eight potential direction indicators comprises both capture indicia and defense indicia;

p) wherein at least one said capture indicia and at least one said defense indicia are angularly spaced substantially forty-five degrees apart;

r) wherein said at least one position-2 potential indicator comprises capture indicia;

s) wherein said at least one position-3 potential indicator comprises capture indicia;

t) wherein said at least one position-4 potential indicator comprises defense indicia;

u) wherein said at least one position-6 potential indicator comprises defense indicia;

v) wherein said at least one position-7 potential indicator comprises capture indicia; and w) wherein said at least one position-8 potential indicator comprises capture indicia.

7. A game piece comprising, in combination:

a) at least eight potential direction indicators;

b) wherein said at least eight potential direction indicators comprise;

c) at least one position-1 potential indicator directed at substantially zero degrees;

d) at least one position-2 potential indicator directed at substantially forty-five degrees from said at least one position-1 potential indicator;

e) at least one position-3 potential indicator directed at substantially ninety degrees from said at least one position-1 potential indicator;

f) at least one position-4 potential indicator directed at substantially one-hundred-thirty-five degrees from said at least one position-1 potential indicator;

g) at least one position-5 potential indicator directed at substantially one hundred-eighty degrees from said at least one position-1 potential indicator;

h) at least one position-6 potential indicator directed at substantially two-hundred-twenty-five degrees from said at least one position-1 potential indicator;

i) at least one position-7 potential indicator directed at substantially two-hundred-seventy degrees from said at least one position-1 potential indicator; and j) at least one position-8 potential indicator directed at substantially three-hundred fifteen degrees from said at least one position-1 potential indicator;

k) wherein at least one of said at least eight potential direction indicators comprises capture indicia;

l) wherein each said capture indicia is permanently fixed to said game piece;

m) wherein said at least one game piece comprises no more than, and no less than, six capture indicia;

n) wherein said at least one position-1 potential indicator comprises capture indicia;

o) wherein said at least one position-2 potential indicator comprises capture indicia;

p) wherein said at least one position-3 potential indicator comprises capture indicia;

q) wherein said at least one position-5 potential indicator comprises capture indicia;

r) wherein said at least one position-7 potential indicator comprises capture indicia; and s) wherein said at least one position-8 potential indicator comprises capture indicia.

8. A game piece comprising, in combination:

a) at least eight potential direction indicators;

b) wherein said at least eight potential direction indicators comprise;

c) at least one position-1 potential indicator directed at substantially zero degrees;

d) at least one position-2 potential indicator directed at substantially forty-five degrees from said at least one position-1 potential indicator;

e) at least one position-3 potential indicator directed at substantially ninety degrees from said at least one position-1 potential indicator;

f) at least one position-4 potential indicator directed at substantially one-hundred-thirty-five degrees from said at least one position-1 potential indicator;

g) at least one position-5 potential indicator directed at substantially one hundred-eighty degrees from said at least one position-1 potential indicator;

h) at least one position-6 potential indicator directed at substantially two-hundred-twenty-five degrees from said at least one position-1 potential indicator;

i) at least one position-7 potential indicator directed at substantially two-hundred-seventy degrees from said at least one position-1 potential indicator; and j) at least one position-8 potential indicator directed at substantially three-hundred fifteen degrees from said at least one position-1 potential indicator;

k) wherein at least one of said at least eight potential direction indicators comprises capture indicia;

l) wherein each said capture indicia is permanently fixed to said game piece;

wherein said at least one game piece comprises no more than, and no less than, five capture indicia;

n) wherein said at least one position-1 potential indicator comprises capture indicia;

o) wherein said at least one position-2 potential indicator comprises capture indicia;

p) wherein said at least one position-4 potential indicator comprises capture indicia;

q) wherein said at least one position-6 potential indicator comprises capture indicia; and r) wherein said at least one position-8 potential indicator comprises capture indicia.

9. A game piece comprising, in combination:

a) at least eight potential direction indicators;

b) wherein said at least eight potential direction indicators comprise;

c) at least one position-1 potential indicator directed at substantially zero degrees;

d) at least one position-2 potential indicator directed at substantially forty-five degrees from said at least one position-1 potential indicator;

e) at least one position-3 potential indicator directed at substantially ninety degrees from said at least one position-1 potential indicator;

f) at least one position-4 potential indicator directed at substantially one-hundred-thirty-five degrees from said at least one position-1 potential indicator;

g) at least one position-5 potential indicator directed at substantially one hundred-eighty degrees from said at least one position-1 potential indicator;

h) at least one position-6 potential indicator directed at substantially two-hundred-twenty-five degrees from said at least one position-1 potential indicator;

i) at least one position-7 potential indicator directed at substantially two-hundred-seventy degrees from said at least one position-1 potential indicator; and j) at least one position-8 potential indicator directed at substantially three-hundred fifteen degrees from said at least one position-1 potential indicator;

k) wherein at least one of said at least eight potential direction indicators comprises capture indicia;

wherein each said capture indicia is permanently fixed to said game piece;

wherein said at least one game piece comprises no more than, and no less than, four capture indicia;

n) wherein said at least one position-2 potential indicator comprises capture indicia;

o) wherein said at least one position-3 potential indicator comprises capture indicia;

p) wherein said at least one position-7 potential indicator comprises capture indicia; and q) wherein said at least one position-8 potential indicator comprises capture indicia.

* * * * *